United States Patent [19]

Hodgman et al.

[11] 4,133,052

[45] Jan. 9, 1979

[54] PROTECTIVE ARRANGEMENT FOR BEAUTY SALON PATRON

[75] Inventors: Elizabeth L. Hodgman, Rt. 2, Box 231, Crawfordville, Fla., 32327; Robert O. Hodgman, Lauderdale-by-the-Sea, Fla.

[73] Assignee: Elizabeth L. Hodgman, Crawfordville, Fla.

[21] Appl. No.: 859,121

[22] Filed: Dec. 9, 1977

[51] Int. Cl.[2] ..... A42B 1/18

[52] U.S. Cl. ..... 2/174; 2/209

[58] Field of Search ..... 2/174, 171.2, 209; 132/9

[56] References Cited

U.S. PATENT DOCUMENTS

| | | | |
|---|---|---|---|
| 2,600,557 | 6/1952 | Marriott | 132/9 |
| 2,729,823 | 1/1956 | Foster | 2/174 |
| 3,235,882 | 2/1966 | Coleman | 2/174 |

*Primary Examiner*—Doris L. Troutman

*Attorney, Agent, or Firm*—Oltman and Flynn

[57] ABSTRACT

The present protective arrangement for a beauty salon patron has a flexible, heat-resistant and moisture-resistant cape with a trough at its lower end which is detachable so that the cape may be held up against the bottom of the hair dryer hood at the back of the wearer's head by an elastic cord. This protective arrangement also has a heat-resistant and moisture-resistant head band which substantially covers the wearer's forehead and has ear flaps to cover the ears, and a transparent visor to cover the nose and eyes.

18 Claims, 6 Drawing Figures

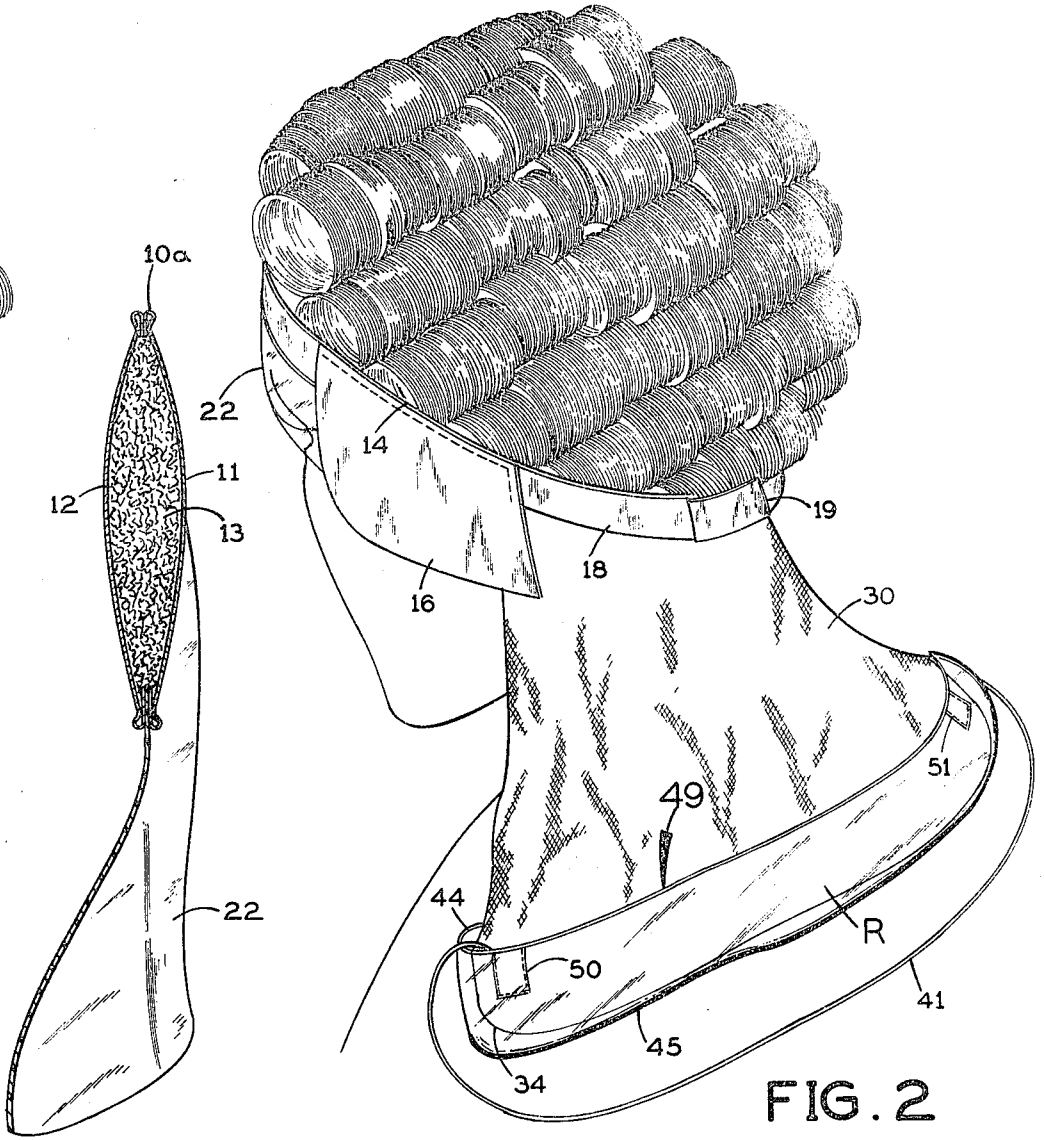
FIG. 2
FIG. 4
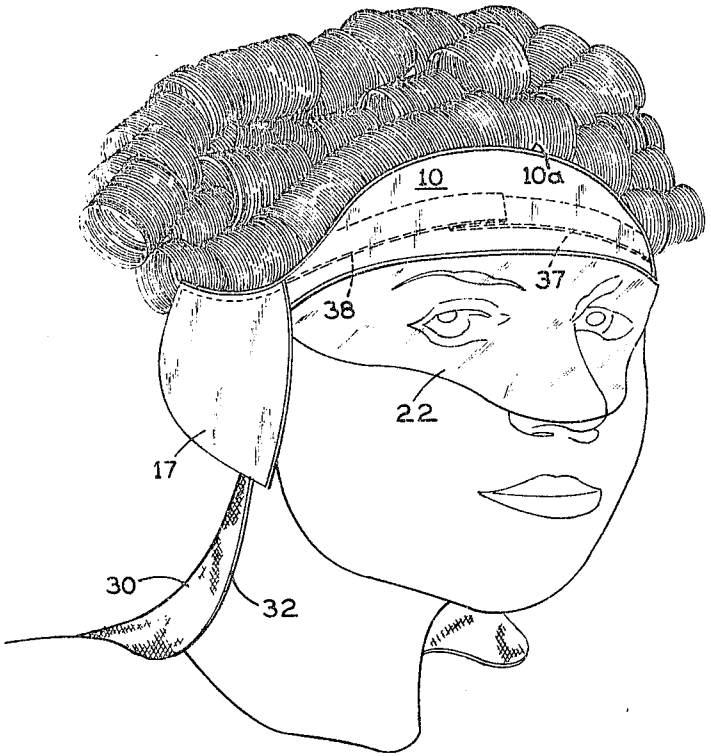
FIG. 1

PROTECTIVE ARRANGEMENT FOR BEAUTY SALON PATRON

BACKGROUND OF THE INVENTION

Prior to the present invention beauty salon patrons have been subjected to discomfort while under hair dryers. The principal complaints have been about excessive heat on the forehead, the ears and the back of the neck. Patrons who have cataracts or wear contact lenses or have asthma also have complained of discomfort in the eyes and sinuses.

The present invention is directed to a novel protective arrangement to be worn by beauty salon patrons to avoid discomfort due to excessive heat from the hair dryer.

SUMMARY OF THE INVENTION

In its complete embodiment the present invention comprises:

(1) a flexible cape to cover the back of the wearer's neck, a receptacle which is connected to the lower end of this cape while the permanent wave solution is being applied to the hair and then is detached from the cape before the hair dryer is turned on, and an elastic cord for holding the cape up against the bottom of the hair dryer to more effectively retain heat against the hair; and (2) a flexible head band with a transparent visor to cover the wearer's eyes and nose, ear flaps to cover the ears, and an insulated middle segment to extend across the forehead, all to protect the wearer from heat-induced discomfort which otherwise might be caused by the hair dryer.

A principal object of this invention is to provide a novel and improved arrangement for protecting a beauty salon patron against discomfort due to heat from a hair dryer.

Another object of this invention is to provide such an arrangement having a flexible, liquid resistant cape to protect the back of the patron's neck while the solution is being applied, and a receptacle on the lower end of the cape which catches the solution running down the cape and is detachable thereafter to permit the cape to be held tightly against the bottom of the hair dryer hood during the drying operation.

Another object of this invention is to provide a novel head band arrangement for protecting the forehead, eyes, nose and ears against excessive heat from a hair dryer.

Another object of this invention is to provide a novel protective arrangement for a beauty salon patron which combines the novel head band arrangement just mentioned with the protective cape and detachable receptacle referred to in the preceding object of the invention.

Further objects and advantages of this invention will be apparent from the following detailed description of a presently-preferred embodiment thereof, which is shown in the accompanying drawings in which:

FIG. 1 is a front perspective view of a woman wearing the present protective arrangement;

FIG. 2 is a rear perspective view showing the same arrangement;

FIG. 4 is a vertical section through the middle of the head band, taken along the line 4—4 in FIG. 3;

Figures 3, 5, 6:
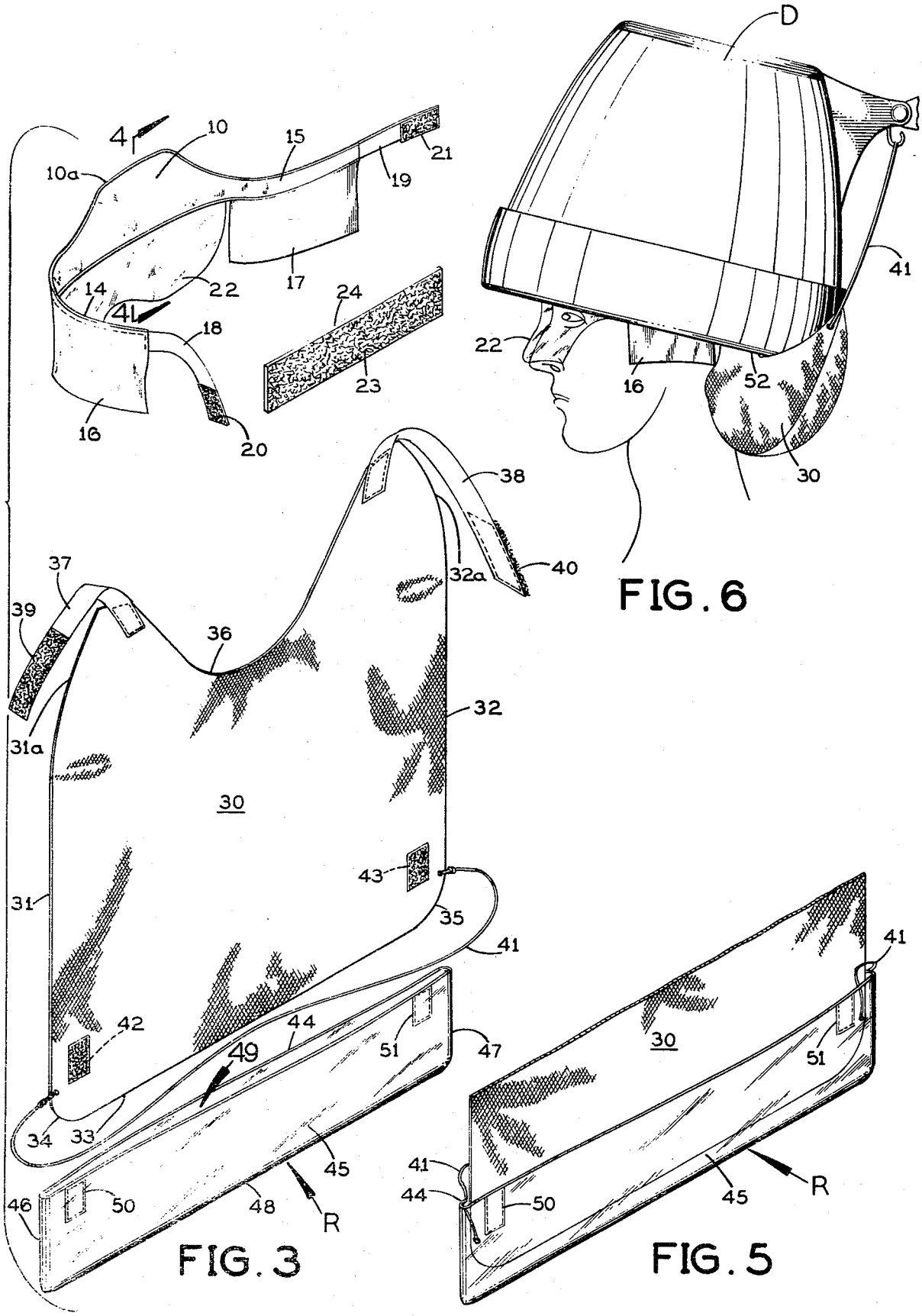
FIG. 3 is an exploded perspective view showing the different parts of the present protective arrangement disassembled.
FIG. 5 is a fragmentary perspective view showing the receptacle attached to the lower end of the cape.
FIG. 6 is an elevational view showing how the present protective arrangement is worn when the beauty salon patron is under the hair dryer.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Referring first to FIGS. 1–4, one aspect of this invention is concerned with the provision of a head band to be worn on the user's head when under a hair dryer D (FIG. 6).

This head band has a padded middle segment 10 (FIG. 3) with an upwardly bowed or offset top edge 10*a* which is shaped and dimensioned to conform substantially to a person's hair line at the forehead. As shown in FIG. 4, this middle segment 10 of the head band has front and back panels 11 and 12 of vinyl fabric or other suitable moisture-resistant and heat-resistant material which are sewed to each other at the top and bottom, and a compressible and resilient filler pad 13 of suitable heat insulation material between these panels.

The head band also has unpadded side segments 14 and 15 extending from the opposite ends of the padded middle segment 10. Preferably, these side segments consist of extensions of the front and back panels 11 and 12 of the middle segment sewed to each other along the top and bottom but without any padding between them.

Ear flaps 16 and 17, preferably of the same vinyl fabric material, are sewed respectively to the side segments 14 and 15 and extend down from them to cover the wearer's ears, as shown at 16 in FIG. 6.

The middle segment 10, the opposite side segments 14 and 15, and the ear flaps 16 and 17 are all readily flexible to conform easily to the wearer's head.

Elongated, flexible tie members 18 and 19 are attached to the respective side segments 14 and 15 of the head band at their respective outer ends (away from the middle segment 10 of the head band). Preferably, these tie members are of suitable elastic material so that they are stretchable longitudinally to fit the head band snugly on different sized heads. The tie members carry fastener elements 20 and 21 at their free ends which are manually attachable to and detachable from each other. Preferably, these fastener elements are of "Velcro" fabric, which provides a multiplicity of mutually interlocking fastener elements which interlock securely with each other when the two fabric elements are pressed together but may be separated readily by a deliberate manual pull.

The head band has a transparent visor 22 which extends down from the middle segment 10 of the head band. This visor extends substantially from one ear flap 16 to the other ear flap 17 and it completely covers the wearer's face at the eyes and nose, as shown in FIG. 1. Preferably, this visor is shaped complementary to the wearer's face across the eyes and nose so that it will be very close to this part of the wearer's face, as shown in FIG. 6. The nose portion of the visor is long enough to cover the wearer's nose completely or substantially so, and the wearer's eyes are completely covered, as shown in FIG. 1.

A thin, elongated, flexible pad 23 (FIG. 3) of liquid-absorbing foam material with a vinyl fabric facing 24 on one major face is inserted between the wearer's forehead and the inside of the middle segment 10 of the head band when solution is being applied to the hair. Preferably, this pad is long enough (e.g., 7 inches) to extend completely across the wearer's forehead from temple to temple. The vertical width of the pad (e.g., 1¾ inches) is enough to cover most of the forehead between the hairline and the eyebrow. In use, the unlined major face of the pad 23 is next to the wearer's forehead to soak up any liquid solution that may run down from the hair onto the forehead. After this has been done and before the hair dryer is turned on the absorbent pad 23 is removed.

Another aspect of the present invention is concerned with providing a protective accessory which comprises a cape for protecting the back of the wearer's neck and a detachable receptacle at the bottom of this cape to catch any liquid solution that runs down the cape from the back of the head.

The cape (FIG. 3) comprises a thin flexible sheet 30 of vinyl fabric or other suitable moisture-resistant and heat-resistant material. The cape is generally in the shape of a bib, with generally parallel, opposite, straight side edges 31 and 32, and a straight bottom edge 33 which is joined to the side edges by respective rounded bottom corners 34 and 35. Toward their upper ends the side edges 31 and 32 taper inward toward one another, as shown at 31*a* and 32*a* in FIG. 3. At its top edge the cape is offset downwardly at the middle to provide a concave edge segment 36 which is shaped and dimensioned to closely fit the back of the wearer's head beneath the hair, as indicated in FIG. 2.

On opposite sides of this downwardly offset top edge segment 36, elongated flexible tie members 37 and 38 are fixedly attached to the top of the cape. Preferably, each of these tie members contains elastic material enabling it to be stretched longitudinally. These tie members are long enough to overlap one another at the wearer's forehead when the top edge segment 36 is snug against the back of the head. At their outer ends the tie members 37 and 38 carry manually separable fasteners 39 and 40, preferably of interlocking "Velcro" fabric, which are engageable with each other to hold the cape firmly on the wearer's head.

A thin elongated, elastic cord 41 is tied to the cape at its opposite bottom corners 34 and 35.

"Velcro" fabric fastener elements 42 and 43 are attached to the inside of the cape near the bottom corners 34 and 35.

The receptacle R for attachment to the lower end of the cape 30 has an inner flap 44 and an outer flap 45 which are joined integrally to each other along opposite side edges at 46 and 47 and along a bottom edge at 48. The receptacle R is open along the top between the inner and outer flaps, as shown at 49 in FIG. 3. Preferably, the receptacle is made of a suitable moisture-resistant, flexible plastic material. "Velcro" fastener elements 50 and 51 are permanently fastened to the inside of the inner flap 44. These fastener elements are engageable respectively with the fastener elements 42 and 43 near the bottom corners of the cape 30 to attach the receptacle to the cape at the bottom. As shown in FIG. 5, when such attachment is made, the lower end of the cape 30 extends about three inches down into the receptacle R to insure that any liquid which runs down the cape will go into the receptacle.

While the treatment liquid is being applied to the hair and before the drying operation begins, the cape 30 and receptacle R are positioned as shown in FIG. 2. Any liquid which runs down the cape 30 will be caught in the receptacle R.

Just before the hair dryer is placed over the person's head, the receptacle R is detached from the lower end of the cape 30 by separating the fastener elements 42, 50 and 43, 51.

Then the elastic cord 41 is looped over the hair dryer at the back in any suitable fashion, such as shown in FIG. 6, to hold the lower end of the cape 30 snugly against the bottom edge of the hair dryer hood at the back, as shown at 52. Consequently, the lower half of the hood is pulled up to form a barrier or deflector which causes heated air coming down the back of the wearer's head to be deflected back up into the dryer hood. In this fashion, the back of the wearer's neck is effectively shielded from the head of the hair dryer and more effective use is made of the heat output of the dryer.

Forward of the hood 30, the head band provides a heat shield for the wearer at the ears, forehead, eyes and nose, as shown clearly in FIG. 1.

It will be apparent from the foregoing that the present invention enables the beautician to protect the patron before her head is under the dryer against excess hair treatment liquid which might tend to run down the forehead or the back of the head, and after the patron's head is under the dryer to protect the forehead, eyes, nose, ears and back of the neck against excessive heat, as well as retaining more of the dryer's heat in proximity to the hair. The forehead pad 23 is reusable after the solution has been squeezed from it and rinsed. The receptacle R and cape 30 are reusable after rinsing, and the head band is reusable after suitable cleaning. The invention is particularly advantageous for use in connection with heat distribution for acid balance permanents.

We claim:

1. A hair treatment accessory comprising:

a flexible cape of moisture-resistant and heat-resistant material shaped and dimensioned to cover the back of the wearer's neck, said cape having a top edge which is downwardly offset at the middle to provide a concave edge segment which closely fits the back of the wearer's head substantially beneath the hair;

elongated flexible tie members attached to the top of the cape on opposite sides of said downwardly-offset, middle segment of the top edge of the cape, said tie members carrying manually separable fastener elements located away from their respective attachments to the cape, said fastener elements being engageable with each other in front of the wearer's forehead to hold the cape on the wearer's head;

an open-topped receptacle which is substantially as wide as the cape from side to side, said receptacle having an inner flap for attachment to the lower end of the cape and an outer flap connected to the inner flap at the opposite sides and at the bottom of the latter to form with said inner flap a trough which is open at the top for catching liquid running down the cape from the wearer's hair;

and manually separable fastener elements on the lower end of the cape and said inner flap for attaching said receptacle to the cape with the lower end of the cape extending down into said receptacle.

2. The hair treatment accessory of claim 1, wherein said tie members have elastic material therein enabling them to be stretched longitudinally.

3. The hair treatment accessory of claim 2, wherein said fastener elements on said tie members are of mutually interlocking fabric material.

4. The hair treatment accessory of claim 1, wherein said fastener elements on said tie members are of mutually interlocking fabric material.

5. The hair treatment accessory of claim 1, wherein said fastener elements on the lower end of the cape and the inner flap of the receptacle are of mutually interlocking fabric material.

6. A hair treatment accessory according to claim 1, and further comprising an elastic cord having its opposite ends connected to opposite sides of the cape near its lower end.

7. The hair treatment accessory of claim 6, wherein:
said tie members are of elastic material;
said fastener elements on said tie members are of mutually interlocking fabric material;
and said fastener elements on the lower end of the cape and the inner flap of the receptacle are of mutually interlocking fabric material.

8. A head band to be worn by a person under a hair dryer, said head band having:
a flexible middle segment with an upwardly offset top edge shaped and dimensioned to substantially follow the wearer's hairline at the forehead, said middle segment having a length sufficient to extend substantially completely across the wearer's forehead from temple to temple;
flexible side segments extending from the opposite ends of said middle segment;
ear flaps extending down from said side segments to cover the wearer's ears;
said middle segment, side segments and ear flaps being of moisture-resistant and heat-resistant material;
flexible tie members attached to said side segments, said tie members carrying manually separable fastener elements located away from their respective attachments to said side segments, said fastener elements being engageable with each other at the back of the wearer's head to hold the head band on the wearer's head;
and a transparent visor extending down from said middle segment and shaped substantially complementary to the wearer's face at the eyes and nose to closely cover the eyes and nose.

9. The head band of claim 8, wherein said middle segment is padded with heat-resistant material.

10. The head band of claim 8, wherein said tie members have elastic material therein enabling them to be stretched longitudinally.

11. The head band of claim 8, wherein said fastener elements on said tie members are of mutually interlocking fabric material.

12. A head band according to claim 8, in combination with a pad of liquid absorbing foam material which fits behind said middle segment at the wearer's forehead.

13. The head band of claim 9, wherein:
said tie members have elastic material therein enabling them to be stretched longitudinally;
and said fastener elements on said tie members are of mutually interlocking fabric material.

14. A head band according to claim 8, in combination with a hair treatment accessory comprising:
a flexible cape of moisture-resistant and heat-resistant material shaped and dimensioned to cover the back of the wearer's neck, said cape having a top edge which is downwardly offset at the middle to provide a concave edge segment which closely fits the back of the wearer's head substantially beneath the hair;
elongated flexible tie members attached to the top of the cape on opposite sides of said downwardly-offset, middle segment of the top edge of the cape, said tie members carrying manually separable fastener elements located away from their respective attachments to the cape, said fastener elements being engageable with each other in front of the wearer's forehead to hold the cape on the wearer's head;
an open-topped receptacle which is substantially as wide as the cape from side to side, said receptacle having an inner flap for attachment to the lower end of the cape and an outer flap connected to the inner flap at the opposite sides and at the bottom of the latter to form with said inner flap a trough which is open at the top for catching liquid running down the cape from the wearer's hair;
and manually separable fastener elements on the lower end of the cape and said inner flap for attaching said receptacle to the cape with the lower end of the cape extending down into said receptacle.

15. The combination of claim 14, wherein:
said middle segment of the head band is padded with heat-resistant material;
said tie members on the head band have elastic material therein enabling them to be stretched longitudinally;
said fastener elements on said head band tie members are of mutually interlocking fabric material;
said tie members on the cape have elastic material therein enabling them to be stretched longitudinally;
said fastener elements on said cape tie members are of mutually interlocking fabric material;
and said fastener elements on the lower end of the cape and said inner flap of the receptacle are of mutually interlocking fabric material.

16. The combination of claim 15, and further comprising an elastic cord having its opposite ends connected to opposite sides of the cape near its lower end.

17. The combination of claim 16, and further comprising a pad of liquid absorbing foam material which fits behind said middle segment of the head band at the wearer's forehead.

18. The combination of claim 14, and further comprising an elastic cord having its opposite ends connected to opposite sides of the cape near its lower end.

* * * * *